US008424869B2

(12) United States Patent
Korenaga

(10) Patent No.: US 8,424,869 B2
(45) Date of Patent: Apr. 23, 2013

(54) AUTOMATIC DOCUMENT FEEDER

(75) Inventor: Kenji Korenaga, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 0 days.

(21) Appl. No.: 13/362,515

(22) Filed: Jan. 31, 2012

(65) Prior Publication Data

US 2012/0200027 A1 Aug. 9, 2012

(30) Foreign Application Priority Data

Feb. 7, 2011 (JP) ..... 2011-024187

(51) Int. Cl.
*B65H 29/00* (2006.01)

(52) U.S. Cl.
USPC ..... 271/186; 271/225

(58) Field of Classification Search ..... 271/184, 271/186, 225, 270
See application file for complete search history.

(56) References Cited

U.S. PATENT DOCUMENTS

| | | | | |
|---|---|---|---|---|
| 5,597,153 | A * | 1/1997 | Maruyama et al. | 271/4.1 |
| 5,907,759 | A * | 5/1999 | Yashiro | 399/371 |
| 6,032,941 | A * | 3/2000 | Endo | 271/3.19 |
| 6,393,251 | B2 * | 5/2002 | Kono | 399/370 |
| 6,402,133 | B1 * | 6/2002 | Miyake | 271/3.19 |
| 6,746,013 | B2 * | 6/2004 | Shih | 271/186 |
| 7,020,429 | B2 * | 3/2006 | Hamada et al. | 399/367 |
| 7,573,619 | B2 * | 8/2009 | Tsai et al. | 358/498 |
| 7,717,423 | B2 * | 5/2010 | Litman et al. | 271/273 |
| 7,775,515 | B2 * | 8/2010 | Shingai | 271/3.14 |
| 7,802,786 | B2 * | 9/2010 | Tsai et al. | 271/186 |
| 7,832,724 | B2 * | 11/2010 | Lo et al. | 271/186 |
| 7,896,343 | B2 * | 3/2011 | Iwago et al. | 271/301 |
| 8,038,144 | B2 * | 10/2011 | Hara | 271/186 |
| 8,121,510 | B2 * | 2/2012 | Roppongi | 399/82 |
| 8,177,225 | B2 * | 5/2012 | Tokutsu | 271/186 |
| 2007/0069451 | A1 * | 3/2007 | Iwago et al. | 271/186 |

FOREIGN PATENT DOCUMENTS

| | | |
|---|---|---|
| JP | 06-247642 A | 9/1994 |
| JP | 10-181955 A | 7/1998 |
| JP | 2010-119080 A | 5/2010 |

* cited by examiner

*Primary Examiner* — Kaitlin Joerger
(74) *Attorney, Agent, or Firm* — Keating & Bennett, LLP

(57) ABSTRACT

An automatic document feeder includes a first roller portion on the first transportation path to feed an original to a scanning position to scan a first face of the original, a second roller portion on a second transportation path to transport the scanned original, a third roller portion on the second transportation path to feed the original to the scanning position to scan a second face of the original, a fourth roller portion on the first transportation path to transport the scanned original, and a transporting speed adjusting unit gaining a circumferential velocity of the second roller portion than the one of the first roller portion and gaining a circumferential velocity of the fourth roller portion than the one of third roller portion, when the original is transported from the first transportation path to the second transportation path and from the second transportation path to the first transportation path, respectively.

6 Claims, 15 Drawing Sheets

AUTOMATIC DOCUMENT FEEDER

CROSS-REFERENCE TO RELATED APPLICATIONS

This application claims priority under 35 U.S.C. 119 to Japanese Patent Application No. 2011-24187, filed on Feb. 7, 2011, which application is hereby incorporated by reference in its entirety.

BACKGROUND OF THE INVENTION

1. Field of the Invention

The present invention relates to an automatic document feeder that makes it possible to scan both front and back faces of an original sheet of paper.

2. Description of the Related Art

As such a document feeder, there is an automatic document feeder (ADF) that automatically feeds an original sheet of paper to an original scanning section having at least a line sensor. Such an ADF is provided in a copier machine or a digital multifunctional peripheral including a scanner function and/or facsimile function as well as a copying function. Some of such copying machines or digital multifunctional peripherals include a function to scan both front and back faces of an original sheet of paper. A document feeder having one original scanning section needs to be devised in terms of transportation path or transportation unit to transport an original sheet of paper.

In one prior art, a guiding path, an inversion path and a delivery path are provided as a transporting path. When a front face of an original is scanned, the original is transported to a scanning position with transportation rollers of the guiding path and is sent out from the scanning position with transportation rollers of the inversion path. When a back face of an original is scanned, the original is transported with other transportation rollers of the inversion path and is sent out from the scanning position with transportation rollers of the delivery path. In this way, different transportation rollers are used when a front face or a back face of an original is scanned.

Further, instead of using different transportation rollers as described above, providing one transportation roller at one side of an image scanning section and rotating the transportation roller in normal and reverse directions, for example, allows the image scanning section to scan both faces of an original by switching the direction in which the original is transported. Furthermore, as another example, by using a triplet roller unit composed of a single drive roller and two driven rollers, both of which rotate in conjunction with the single drive roller, both faces of an original can be scanned by switching the direction in which the original is transported while the drive roller is rotating in one direction.

SUMMARY OF THE INVENTION

Scanning an original clearly at a scanning section is required. Therefore, there has been demand to transport an original with a sufficient drawing tension as it is stretched by increasing a transporting speed downstream the scanning section. However, if each face of an original is scanned when passing through a single original scanning section in two way directions, the original is transported in both directions with the same transportation rollers positioned downstream and upstream the image scanning section. Therefore, if an original is transported in one direction with a sufficient drawing tension as it is stretched, the original is transported as it slightly slackens in an opposite direction. Accordingly, the original is not scanned clearly, which results in image degradation of the scanned document. Further, if each diameter of transportation rollers is slightly different in terms of manufacturing, the transporting speed varies, and therefore an original is transported in one direction as it is stretched and is transported in the opposite direction as it slackens, which lowers scanning quality and results in image degradation.

The present invention has been made to solve the above-described problems. According to this invention, the following ADF will be provided: even if any one of individually different transportation rollers, a transportation roller capable of rotating in both normal and reverse directions or a triplet roller unit are used as a transportation roller(s), the original can be transported with a sufficient tension when passing through an original scanning section in two way directions.

To solve the problems stated above, the ADF according to the present invention includes an original scanning section to scan a front face of an original sheet of paper, a first transportation path provided at one side of a scanning position of the original scanning section to guide the original to the scanning position of the original scanning section so that a first face of the original can be scanned, a looped second transportation path provided at the other side of the scanning position to guide the original to the scanning position so that a second face of the original can be scanned, a first roller portion provided at the first transportation path to feed the original to the scanning position so that the first face of the original can be scanned, a second roller portion provided at the second transportation path to transport the original sent out from the first roller portion and scanned at the scanning position along the second transportation path, a third roller portion provided at the second transportation path to send the original to the scanning position so that the second face of the original can be scanned, a forth roller portion provided at the first transportation path to transport the original sent out from the third roller portion and scanned at the scanning position, an original transportation control section that controls to transport the original through the first and second roller portions from the first transportation path to the second transportation path when the first face of the original is scanned, and to transport the original through the third and fourth roller portions from the second transportation path to the first transportation path when the second face of the original is scanned, and a transporting speed adjusting unit that controls a circumferential velocity of the second roller portion to be faster than the one of the first roller portion when the original is transported from the first transportation path through the scanning position to the second transportation path, and also controls a circumferential velocity of the fourth roller portion to be faster than the one of the third roller portion when the original is transported from the second transportation path through the scanning position to the first transportation path.

Operation and effect of the ADF having the above configuration will be described below. In this ADF, a first transportation path is provided at one side of an original scanning section and a second transportation path is provided at the other side of the scanning section. When a first face of an original (e.g., front face) is scanned, the original is transported so as to pass through a scanning position of the original scanning section through a first roller portion and a second roller portion. The original whose first face has been scanned is returned to the scanning position of the original scanning section through a looped second transportation path, and then a second face of the original (e.g., back face) is scanned. In this case, the original is transported through a third roller portion and a forth roller portion. When an original is transported from the first transportation path through the scanning position of the original scanning section to the second transportation path, a circumferential velocity of a second roller portion (V2) is faster than the one of a first roller portion (V1). In addition to this, when an original is transported from the second transportation path through the scanning position of the original scanning section to the first transportation path, a circumferential velocity of a fourth roller portion (V4) is faster than the one of a third roller portion (V3). Therefore, as the original is transported with a sufficient drawing tension even if passing through in two way directions, the original can be scanned clearly.

In the above-described invention, each of the first roller portion and the fourth roller portion may be configured separately as individual transportation rollers (drive roller and driven roller which rotates in conjunction with the drive roller), be a roller unit (so-called triplet roller unit) having a drive roller and a first and second rollers, both of which rotate in conjunction with the drive roller, or be a normal and reverse rotation roller unit having a drive roller capable of rotating in both normal and reverse directions and a driven roller, which rotates in conjunction with the drive roller. Further, each of the second roller portion and the third roller portion may be configured as individual transportation rollers, be a roller unit having a drive roller and a first and second rollers, both of which rotate in conjunction with the drive roller, or be a normal and reverse rotation roller unit having a drive roller capable of rotating in both normal and reverse directions and a driven roller, which rotates in conjunction with the drive roller.

In the above-described invention, in a case where each of the first roller portion, the second roller portion, the third roller portion and the fourth roller portion is configured separately as individual transportation rollers, the following relations may be established with regard to a circumferential velocity between the roller portions: V1<V2 and also V3<V4. Further in a case where the first roller portion and the fourth roller portion are configured as a triplet roller unit and also each of the second roller portion and the third roller portion is separately configured as an individual transportation roller, or in a case where the second roller portion and the third roller portion are configured as a triplet roller unit and also each of the first and fourth roller portions is separately configured as an individual transportation roller, a rotation frequency or a circumferential velocity of a drive roller provided in a side of the separately configured transportation roller may be set to establish the above-described relations (V1<V2 and also V3<V4) while a rotation frequency or a circumferential velocity of a single drive roller of the triplet roller unit is maintained at a given level, or as a preferred embodiment described later, a diameter of a single drive roller of a triplet of rollers may be changed between two triplet roller units to establish the above described relations. Furthermore, in a case where the first roller portion and the fourth roller portion are configured as a normal and reverse rotation unit and also the second roller portion and the third roller portion are configured as a triplet roller unit, or in a case where the second roller portion and the third roller portion are configured as a normal and reverse rotation unit and also the first roller portion and the fourth roller portion are configured as a triplet roller unit, the rotation frequency (both normal and reverse directions) of the driver roller provided at a side of the normal and reverse rotation roller may be set to establish the above described circumferential velocities relations (V1<V2 and also V3<V4) while a rotation frequency or a circumferential velocity of a drive roller of the triplet roller unit is maintained at a given level, or as the preferred embodiment described later, a diameter of a single drive roller of a triplet of rollers may be changed between two triplet roller units to establish the above described circumferential velocity relations while the rotation frequency in normal and reverse directions is maintained at a certain level.

Further, in the above-described invention, a transporting speed adjusting unit may be configured as follows: a rotation frequency adjusting section that controls a rotation frequency of each roller portion so that a circumferential velocity of roller portions can be maintained to established the desired relations therebetween, be configured by changing the number of gear teeth used in a transmission unit in which a rotary drive of a motor (gear ratio adjustment) is transmitted, or be configured by changing a diameter of each roller of roller portions. The motor may be a motor rotating in one direction or a motor capable of rotating in both normal and reverse directions.

As one favorable preferred embodiment of the above described invention, an ADF includes a single drive roller and a first driven roller and a second driven roller, both of which rotate in conjunction with the drive roller. In the roller unit, the first roller portion consists of the drive roller and the first driven roller, and also the fourth roller portion consists of the drive roller and the second driven roller portion, or the second roller portion consists of the drive roller and the first driven roller, and also the third roller portion consists of the drive roller and the second driven roller. In a case where the transporting speed adjusting unit is configured with a roller unit consisting of the first roller portion and the fourth roller portion, a diameter D1 of the drive roller in contact with the first driven roller of the first roller portion is set to be smaller than a diameter D4 of the drive roller in contact with the second driven roller of the fourth roller portion, and in a case where the transporting speed adjusting unit is configured with a roller unit consisting of the second roller portion and the third roller portion, a diameter D2 of the drive roller in contact with the first driven roller is set to be larger than a diameter D3 of the drive roller in contact with the second driven roller of the third roller portion.

In this configuration, either one of the first and fourth roller portions or the second and third roller portions is configured with a triplet roller unit, and circumferential velocities of a triplet of rollers are set to establish the relations "V1<V4 and also V3<V2" by adjusting a diameter of a single drive roller of a triplet of rollers to establish the relations "D1<D4 and also D3<D2".

As one favorable preferred embodiment of the above described invention, the ADF includes a normal and reverse rotation roller portion having a single drive roller and a single driven roller which rotates in conjunction with the drive roller. The first roller portion consists of the drive roller rotating in a normal direction and the driven roller, and also the fourth roller portion consists of the drive roller which rotates in a reverse direction and the driven roller. The ADF also include a roller unit having a single drive roller and a first driven roller and a second driven roller, both of which rotate in conjunction with the drive roller. The second roller portion consists of the drive roller and the first driven roller, and also the third roller portion consists of the drive roller and the second driven roller. The original transporting control section controls to transport the original from the first transportation path to the second transportation path through the first roller portion rotating in a normal direction and the second roller portion when a first face of the original is scanned, and to transport the original from the second transportation path to the first transportation path through the third roller portion and the fourth roller portion rotating in a reverse direction when a second face of the original is scanned. The transporting speed adjusting unit is configured with the normal and reverse rotation roller unit and the roller unit, and the normal and reverse rotation roller portion in rotating both normal and reverse directions and the roller of the roller unit are set to rotate at the same rotation frequency, and an external diameter of the normal and reverse rotation roller portion is set to be smaller than an external diameter of the drive roller in contact with the first driven roller of the second roller portion and is also set to be larger than an external diameter of the drive roller in contact with the second driven roller of the third roller portion.

In this configuration, the first and fourth roller portions are configured as a single normal and reverse rotation roller portion, and the second and third roller portions are configured as a roller unit (triplet roller unit). When the normal and reverse rotation roller portion in rotating both normal and reverse directions and the roller of the roller unit are set to rotate at the same rotation frequency, an external diameter D1 of the drive roller in contact with the driven roller of the normal and reverse roller portion (that is, a peripheral surface in contact with a face of an original) is smaller than an external diameter D2 of the drive roller in contact with the first driven roller of the second roller portion, and also is larger than an external diameter D3 of the drive roller in contact with the second driven roller of the third roller portion. (D2>D1>D3) Accordingly, a circumferential velocity V1 (circumferential velocity of the first roller portion) of the normal and reverse rotation roller portion rotating in a normal direction and a circumferential velocity of the normal and reverse rotation roller portion in rotating in a reverse rotation V4 (circumferential velocity of the fourth roller portion) are slower than a circumferential velocity of the second roller portion V2, and is also faster than a circumferential velocity of the third roller portion V3. (V2>V1=V4>V3)

Further, as yet another favorable preferred embodiment of the above described invention, the ADF includes a first roller unit having a single drive roller and a first driven roller and a second driven roller both of which rotate in conjunction with the drive roller. In the first roller unit, the first roller portion consists of the drive roller and the first driven roller and the fourth roller portion consists of the drive roller and the second driven roller. The ADF also includes a second roller unit having a single drive roller and a first driven roller and a second driven roller both of which rotate in conjunction with the drive roller. In the second roller unit, the second roller portion consists of the drive roller and the first driven roller and the third roller portion consists of the drive roller and the second driven roller. The transporting speed adjusting unit is configured with the first or second roller units. Each drive roller of the first roller unit and the second roller unit is set to rotate at the same rotation frequency and an external diameter of the drive roller in contact with the first and second driven rollers of the first roller unit is set to be smaller than an external diameter of the drive roller in contact with the first driven roller of the second roller portion and is also set to be larger than an external diameter of the drive roller in contact with the second driven roller of the third roller portion, or an external diameter of the drive roller in contact with the first and second driven roller of the second roller unit is set to be larger than an external diameter of the drive roller in contact with the first driven roller of the first roller portion and is also set to be smaller than an external diameter of the drive roller in contact with the second driven roller of the fourth roller portion.

In this configuration, the first and fourth roller portions and the second and third roller portions are configured respectively as a roller unit (triplet roller unit). When the first roller unit and the second roller unit are set to rotate at the same rotation frequency, an external diameter D1 of the drive roller in contact with the first and second driven rollers of the first roller unit is set to be smaller than an external diameter D2 of the driver roller in contact with the first driven roller of the second roller unit, and also is set to be larger than an external diameter D3 of the drive roller in contact with the second driven roller of the third roller portion (D2>D1>D3), or an external diameter D11 of the driver roller in contact with the first and second driven rollers of the second roller unit is set to be larger than an external diameter D12 of the drive roller in contact with the first driven roller of the first roller portion and is also set to be smaller than an external diameter D13 of the driver roller in contact with the second driven roller of the fourth roller portion. (D13>D11>D11) Accordingly, a circumferential velocity V2 of the second roller portion is faster than a circumferential velocity V1 of the first roller portion and also a circumferential velocity V4 of the fourth roller portion is faster than a circumferential velocity V3 of the third roller portion. (V2>V1 and also V4>V3)

As yet another favorable preferred embodiment of the above described invention, the ADF includes a normal and reverse rotation roller portion having a drive roller and a driven roller which rotates in conjunction with the drive roller. In the normal and reverse rotation roller portion, the first roller portion consists of the drive roller rotating in a normal direction and the driven roller, and also the fourth roller portion consists of the drive roller rotating in a reverse direction and the driven roller. The ADF also includes a roller unit having a single drive roller and a first driven roller and a second driven roller both of which rotate in conjunction with the drive roller. In the roller unit, the second roller portion consists of the drive roller and the first driven roller and the third roller portion consists of the drive roller and the second driven roller. The original transportation control section controls to transport the original from the first transportation path to the second transportation path through the first roller portion rotating in a normal direction and the second roller portion when the first face of the original is scanned, and to transport the original from the second transportation path to the first transportation path through the third roller portion and the fourth roller portion rotating in a reverse direction when a second face of the original is scanned. The transporting speed adjusting unit is configured with a transmission unit to transmit rotation of the motor rotating in one direction to the normal and reverse rotation roller portion and the roller unit. With the transmission unit, a gear rotation frequency to rotate the drive roller of the roller unit is set to be faster than a gear rotation frequency to rotate the normal and reverse rotation roller portion in a normal direction and is set to be slower than a gear rotation frequency to rotate the normal and reverse rotation portion in a reverse direction.

In this configuration, the first roller portion and the fourth roller portion are configured as a single normal and reverse roller portion, and the second roller portion and the third roller portion are configured as a roller unit (triplet of rollers). Further, gear ratios are set as follows: a gear rotation frequency R3 in rotating a drive roller of the roller unit is faster than a gear rotation frequency R1 in rotating the normal and reverse rotation roller portion in a normal direction, and also is slower than a gear rotation frequency in rotating the normal and reverse rotation roller portion in a reverse direction. (R2>R3>R1) Accordingly, a circumferential velocity of the second roller portion V2 is faster than a circumferential velocity of the normal and reverse rotation roller portion in rotating in a normal direction V1 (circumferential velocity of the first roller portion) and also a circumferential velocity of the normal and reverse rotation roller portion in rotating in a reverse direction V4 (circumferential velocity of the fourth roller portion) is faster than a circumferential velocity of the third roller portion. (V2>V1 and also 4>V3)

In preferred embodiments including rollers which rotate in both normal and reverse directions, the ADF includes a switching mechanism to switch a rotational direction of the normal and reverse rotation roller portion to a normal or reverse direction, and an actuator that drives the switching mechanism to a normal rotation position or a reverser rotation position. It is preferred that the switching mechanism functions to switch the rotational direction of the normal and reverse rotation roller portion to a normal or reverse rotation by changing the number of gears constituting a gear train driven by the motor. For example, by decreasing or increasing the number of gears one by one, a rotational direction can be switched. Therefore, a switching mechanism may be configured with a decreasing number of components.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
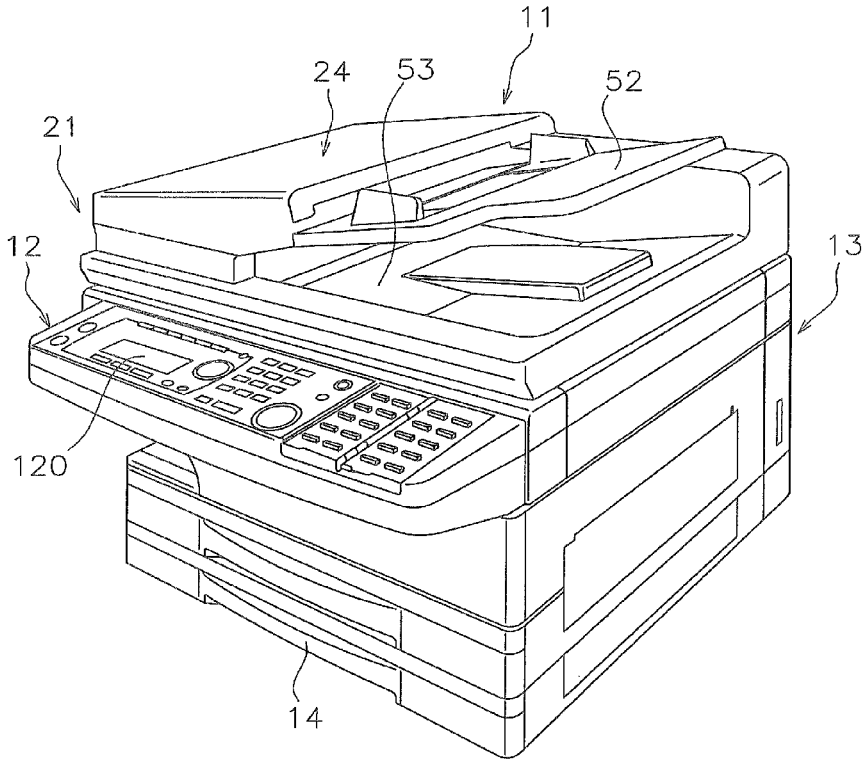
FIG. 1 is a perspective view illustrating an appearance of a digital multifunctional peripheral in which an ADF according to the present invention is adopted.

Preferred embodiments of the present invention will be described below with reference to the drawings. FIG. 1 is a perspective view illustrating an appearance of a digital multifunctional peripheral in which an ADF according to the present invention is adopted.

<Whole Structure of a Multifunctional Peripheral>

A multifunctional peripheral 1 includes a copier function and a facsimile function, and an image scanner (original scanning apparatus) 11 is provided at an upper portion thereof. The multifunctional peripheral 1 also includes an operation panel 12 to instruct the number of copies, a facsimile destination and document scanning or the like.

Further, the multifunctional peripheral 1 includes a multifunctional peripheral body 13 having an internal image forming portion or the like to form an image on a piece of paper as a storage medium, and a paper feed cassette 14 to feed a paper sequentially. The multifunctional peripheral body 13 includes a transmitting/receiving section (not illustrated) to transmit image information via a communication line.

Figure 2:
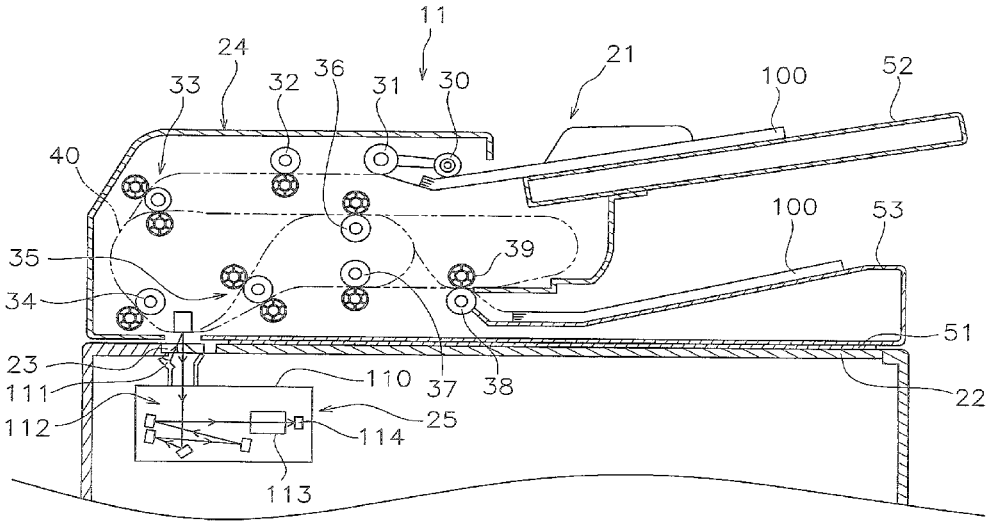
FIG. 2 is a front cross-sectional view illustrating an image scanner apparatus.

Next, with reference to FIG. 2, the image scanner 11 provided in the multifunctional peripheral 1 will be described. FIG. 2 is a front cross-sectional view illustrating a configuration of the image scanner. Herein, a front view refers to a drawing which an original sheet of paper to be fed is viewed from a width direction.

As illustrated in FIG. 2, the image scanner 11 includes a platen cover 21, a platen glass 22, and a contact glass 23. The platen cover 21 is provided with an ADF. The image scanner 11 also includes a scanner unit 25 arranged to scan image information of an original 100 at a lower portion of the platen glass 22 and the contact glass 23.

The scanner unit 25 includes a carriage 110 movable in horizontal direction inside the platen. A light source 111, a plurality of reflection mirrors 112, a condensing lens 113, and a charged-coupled device (CCD) 114 are arranged inside the carriage 110. The light source 111 irradiates light to an original to be scanned, and the light reflected by the original is reflected from the plurality reflection mirrors 112. Then, the light penetrates the condensing lens 113 and converges, and is formed into an image at the CCD 114. Then, the CCD 114 converts the converged incidence light into an electric signal and outputs.

As illustrated in FIG. 2, the ADF 24 included in the platen cover 21 includes a paper feed cassette 52 provided at an upper portion of the platen cover 21, and a paper output tray 53 provided at a lower portion of the paper feed cassette 52. Further, inside the ADF 24, an original transportation path 40 is formed to connect the paper feed tray 52 to the paper output tray 53.

When a user operates an operation panel 12 (equivalent to a display portion) illustrated in FIG. 1 to function the image scanner 11 as an automatic document feeder (ADF), originals 100 stacked on the paper feed cassette 52 are sequentially fed one by one at a time along the original transportation path 40. When the original 100 transported along the original transportation path 40 is passing on a glass surface (scanning position 116) of the contact glass 23, image information of the original 100 is scanned with the scanning unit 25. Then, the original 100 is transported along the original transportation path 40 and output onto the paper output tray 53.

Meanwhile, when using the image scanner 11 as a book scanner, the user places an original 100 to be scanned on the platen glass 22. Then, a platen sheet 51 provided at a lower portion of the ADF 24 presses the original from above to fix the original 100 thereon. The scanner unit 25 scans image information of the original 100 while the carriage 100 is moving in a horizontal direction under this state.

<Detailed Structure of the Automatic Document Feeder>

Next, an internal structure of the ADF 24 will be specifically described below. In the following descriptions, viewed from the front, a side where the paper feed tray 52 is located and its opposite side may be simply referred to as a right side and a left side, respectively.

First Preferred Embodiment

Figure 3:
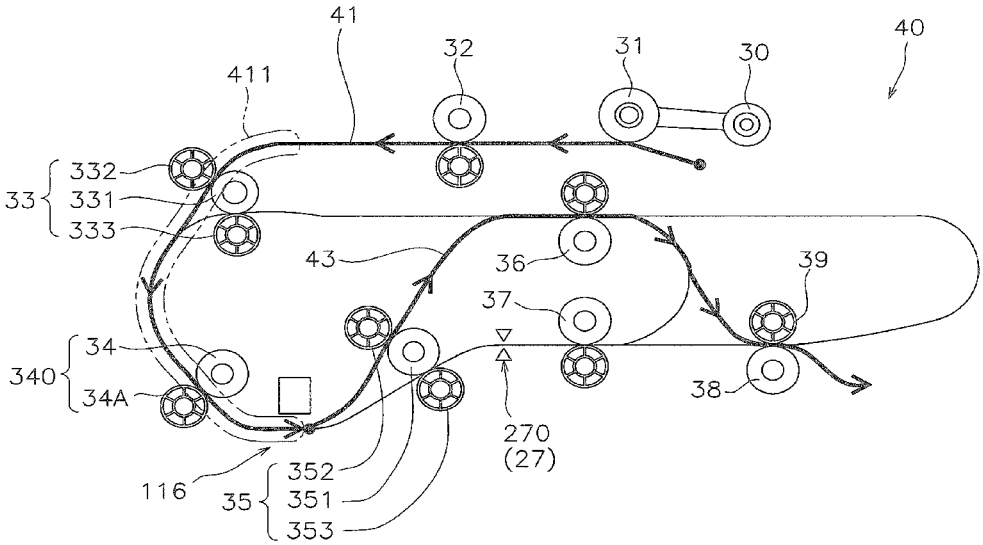
FIG. 3 is a schematic drawing (first preferred embodiment) describing a guiding path and a single face delivery path.

The ADF 24 according to a first preferred embodiment of the present invention is configured so that an original 100 is transported in different paths in cases where one side (first face) of the original 100 is scanned and both sides (first and second faces) of the original 100 are scanned, respectively. Firstly, with reference to FIGS. 2 and 3, descriptions will be made on the path used to scan one side only of the original 100 and components used thereon. FIG. 3 is a schematic drawing describing a guiding path 41 and a single-face delivery path 43. In the first preferred embodiment of the present invention, a first roller portion which feeds the original 100 to the scanner unit 25 (equivalent to an image scanning section) and a fourth roller portion are configured as a normal and reverse rotation roller portion (transportation roller 34 and driven roller 34A), and a second roller portion and a third roller portion are configured as a triplet roller unit (triplet of rollers 35).

When one side only of the original 100 is scanned, as illustrated in FIG. 3, the original 100 is transported along the guiding path 41 arranged to guide the original 100 to a scanning position 116 and the single-face deliver path 43 arranged to guide the original 100 from the scanning position 116 to the paper output tray 53.

The guiding path 41 is provided with a pick-up roller 30, a separation roller 31, a registration roller 32, a triplet of rollers 33, and a transportation roller (feeding roller) 34, which are arranged in this order from an upstream side. Each configuration of rollers arranged on the guiding path 41 from the upstream side to a downstream side will be described below.

In a vicinity of the upstream end of the guiding path 41, the pick-up roller 30 and the separation roller 31 are positioned. The pick-up roller 30 is configured to be capable of rotating upon a rotation axis of the separation roller 31. When the ADF 24 is not operating, the pick-up roller 30 is held at the upper side in FIG. 3. Meanwhile, when the original 100 is fed, the pick-up roller 30 rotates downward and makes contact with an edge portion of the upmost original 100 from the document layers stacked on the paper feed cassette 52. With rotation of the pick-up roller 30 under the state, the upper most original 100 stacked on the paper feed cassette 52 will be transported to the separation roller 31.

The original 100 transported to the separation roller 31 with the pick-up roller 30 rotating are separated one by one with the rotationally-driven separation roller 31 and then transported to the registration roller 32 provided at the downstream side.

The registration roller 32 with its opposite roller temporarily holds a leading edge of the original 100 transported to slack the original 100, and after a prescribed period of time, transports the original 100 to the downstream side while the slack thereof is being eliminated. Accordingly, a bias of the original 100 is corrected. The original 100 which has passed through the registration roller 32 is transported to the triplet of rollers 33 provided at the downstream side.

The guiding path 41 located between the separation roller 31 and a relatively upstream portion of the triplet of rollers 33 is formed in a straight path.

The triplet of rollers 33 is configured with a drive roller 331 positioned in the middle thereof and driven rollers 332 and 333 positioned above and below the drive roller 331 to sandwich the drive roller 331. The original 100 to be transported along the guiding path 41 passes through between the drive roller 331 and the driven roller 332 positioned above the drive roller 332 and is transported diagonally downward left. The original 100 which passed through the triplet of rollers 33 is transported to the transportation roller 34 arranged at the downstream side. The driven roller 333 arranged below the drive roller 331 and the driven roller 332 rotate in opposite directions each other, which enables the drive roller 331 and the driven roller 333 to transport the original 100 which has passed therebetween to the right side.

The transportation roller 34 transports the original 100 diagonally downward right (a side of the scanning position 116) by rotating while nipping the original 100 with the opposite roller. When the original 100 passes through the scanning position 116, image information of the first face (front face) of the original 100 is scanned with the scanner unit 25. The transportation roller 34 is configured to be capable of switching its rotational direction and thus can transport the original 100 diagonally upward left (a side of the triplet of rollers 33) by rotating in a reverse direction.

The guiding path 41 located between a relatively upstream portion of the triplet of rollers 33 and the scanning position 116 is formed to be swelled up leftward (curved to the left) (curved guiding path 411 illustrated in FIG. 3).

<Single-Face Delivery Path>

Next, the single-face delivery path 43 will be described. The single-face delivery path 43 is provided with a triplet of rollers 35, a transportation roller 36, and a shared roller 38 and its opposite roller 39, which are arranged in this order from the upstream side. Each structure of rollers arranged on the single-face delivery path 43 from the upstream side to a downstream side will be described below.

At a relatively downstream side of the scanning position 116, there is a portion branching upward and downward, and in a vicinity of the branching portion, the triplet of rollers 35 is provided. The triplet of rollers 35 is configured with a registration roller 351 provided in the middle thereof (second transportation roller, drive roller) and driven rollers 352 and 353 positioned above and below the registration roller 351 to sandwich the registration roller 351. The original 100 whose image information is scanned by the scanner unit 25 passes through between the registration roller 351 and the driven roller 352 arranged above the registration roller 351 and is transported diagonally upward right. The original 100 which passed through the triplet of rollers 36 is transported to the shared roller 38 located at a diagonally downward right position of the transportation roller 36 with the transportation roller 36 positioned at the downstream side. The registration roller 351 has a similar structure to the above-described registration roller 32, and can correct a bias of the original 100 to be transported to a diagonally downward left position between the registration roller 351 and the driven roller 353 arranged at a lower side thereof.

In the above described configuration, the triplet of rollers 35 is equivalent to a roller unit including a second roller portion and a third roller portion. Further, the registration roller 351 (equivalent to a drive roller) and the driven roller 352 (equivalent to a first driven roller) are equivalent to the second roller portion, and the registration roller 351 and the driven roller 353 (equivalent to a second driven roller) are equivalent to the third roller portion. The triplet of rollers 35 are driven to rotate in one direction (not to rotate in both normal and reverse directions) and specifically the registration roller 351 is driven to rotate in a clockwise direction in FIG. 3.

The shared roller 38 transports the original 100 to the right side by rotating while nipping the original 100 with the opposite roller 39 arranged in the opposite position, and outputs the original 100 to the paper output tray 53. As described above, image information of one side only of the original 100 placed on the paper feed tray 52 is scanned. The shared roller 38 is configured to be capable of switching a rotational direction, and thus can transport the original 100 to the left side (a side of the scanning position 116) by rotating in the opposite direction when the original 100 is transported to the paper output tray 53.

<Duplex Scanning>

Figure 4:
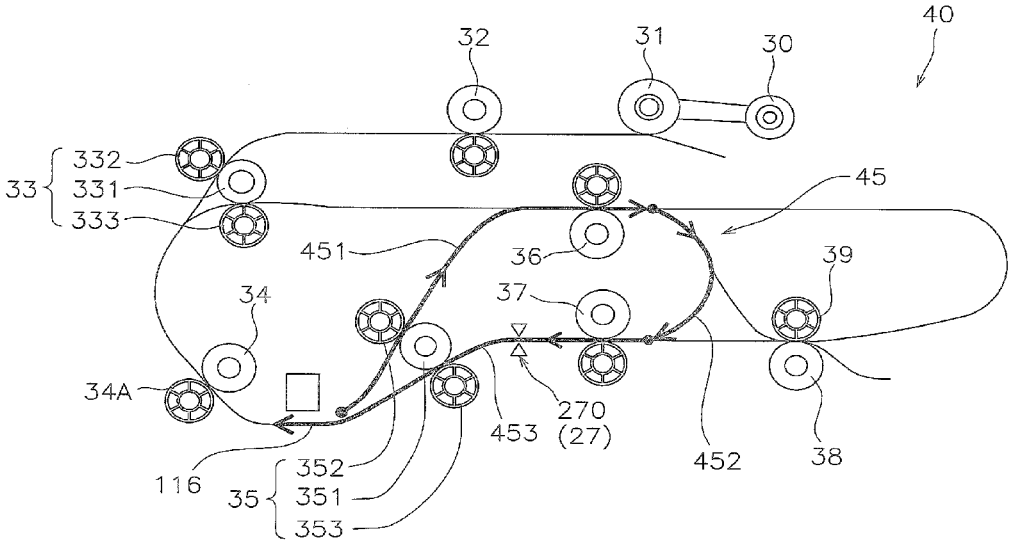
FIG. 4 is a schematic drawing describing a first inversion path.
Figure 5:
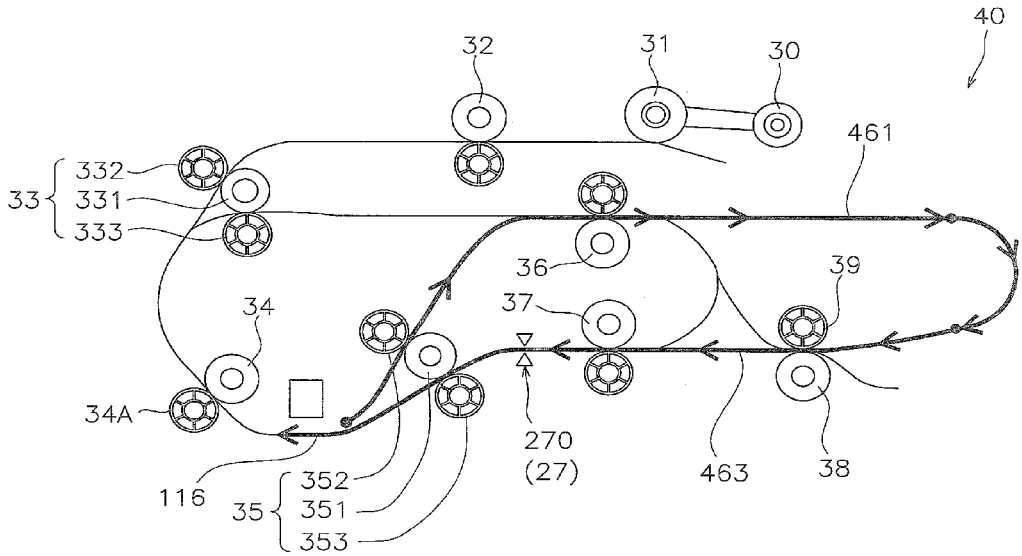
FIG. 5 is a schematic drawing describing a second inversion path.
Figure 6:
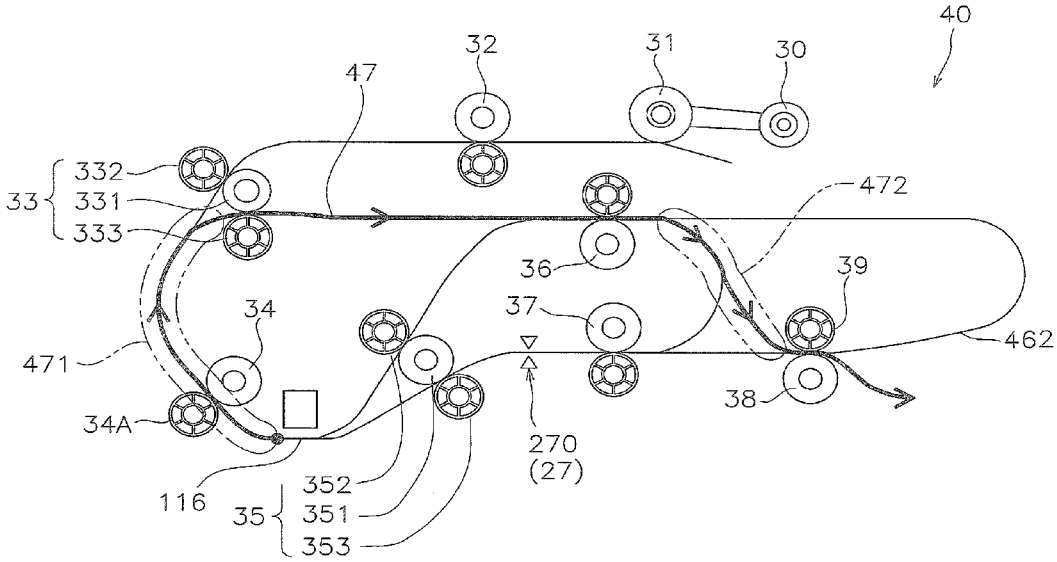
FIG. 6 is a schematic drawing describing a double face delivery path.

Next, with reference to FIGS. 2, 4, 5 and 6, a path used to scan both faces of the original 100 will be described. FIG. 4 is a schematic view describing a first inversion path 45. FIG. 5 is a schematic view describing a second inversion path 46. FIG. 6 is a schematic view describing a double-face delivery path 47.

In the same way as one face only of the original 100 is scanned, when both faces of the original 100 are scanned, the originals 100 placed on the paper feed cassette 52 are also transported to the scanning position 116 along the guiding path 41. Then, image information of a first face of the original 100 is scanned with the scanner unit 25. Further, the ADF 24 of the preferred embodiments of the present invention is configured to be capable of detecting a length of a transporting direction of the original 100 (a length of an original) and switching a path where the original 100 is transported after passing the guiding path 41 by the operation of a path guide (not illustrated) or the like based on the detected length of the original 100.

Firstly, a path which transports an original 100 whose length is short will be described. In this case, the original 100 is transported to the scanning position 116 along the guiding path 41 and then transported along the first inversion path 45 illustrated in FIG. 4. The first inversion path 45 is provided with a first inversion forward path 451, a first inversion middle path 452, and a first inversion backward path 453, which are arranged in this order from the upstream side.

At the first inversion forward path 451, a triplet of rollers 35 and a transportation roller 36, which are arranged from the upstream side, are provided. In the same way as the single-face delivery path 43, the original 100 to be transported along the first inversion front path 451 is transported in diagonally upward right after passing through between the registration roller 351 and the driven roller 352 arranged above the registration roller 351. Then, the original 100 is transported in the right direction with the transportation roller 36 and transported to the first inversion middle path 452.

In the same way as the single-face delivery path 43, the first inversion middle path 452 guides the original 100 in a diagonally downward right direction part of the way. After the original 100 passes through a branching portion on the way, the first inversion middle path 452 guides the original 100 in the diagonally downward left direction. The first inversion middle path 452 is formed to be swelled up rightward (to be curved to the right). As the original 100 is transported along the first inversion middle path 452, a face of the original 100 is inverted. That is, the first face facing downward (a side of the scanner unit 25) until the original 100 is transported along the first inversion middle path 452 is turned to face upward after being transported along the first inversion middle path 452. Then, the original 100 transported along the first inversion middle path 452 is transported to the first inversion rear path 453.

At the first inversion backward path 453, a transportation roller 37 and a triplet of rollers 35, which are arranged in this order from the upstream side, are provided. The original 100 to be transported along the first inversion backward path 453 is transported leftward with the transportation roller 37 and passes through the scanning position 116 after a bias of the original 100 is corrected with the registration roller 351 of the triplet of rollers 35. In this way, the original 100 whose length is short is inverted.

Next, a path which transports the original 100 whose length is long will be described. Hereafter, a long length of an original is that the length of the original 100 is equal to or longer than the length of the first inversion path 45. If the original 100 with a long length is transported along the first inversion path 45, an edge portion of the inverted original 100 is passing through the scanning position 116 while a rear-end portion still remains at the scanning position 116. Therefore, the original 100 overlaps thereon, which causes a paper jam. Thus, as illustrated in FIG. 5, the second inversion path 46, which is used to transport an original 100 whose length is longer, is formed to be longer than the first inversion path 45.

The second inversion path 46 is configured with a second inversion forward path 461, a second inversion middle path 462 and a second inversion backward path 463. The second inversion forward path 461 extends further rightward than the first inversion forward path 451. In the same way as the first inversion middle path 452, the second inversion middle path 462 is formed to be swelled up rightward (curved to the right). The second inversion backward path 463 extends further rightward than the first inversion backward path 453.

The original 100 passes through the shared roller 38 while being transported leftward along the second inversion backward path 463. However, as stated earlier, since the shared roller 38 is capable of switching a rotational direction, the original 100 can be transported leftward with the shared roller 38. In this way, as the shared roller 38 serves as a delivery roller and a transportation roller, the original 100 whose length is longer is inverted with the shared roller 38.

The original 100 whose image information of the second face (back face) is scanned by being inverted with the first inversion path 45 or the second inversion path 46, is transported to the double-face delivery path 47 illustrated in FIG. 6.

The original 100 transported along the double-face delivery path 47 passes through the scanning section 116 leftward and is transported in a diagonally upward left direction with the transportation roller 34. Then the original 100 passes through between the drive roller 331 and the driven roller 333 provided below the drive roller 331, and is transported in the right direction.

The double-face delivery path 47 located between the scanning position 116 and the triplet of rollers 33 is formed to be swelled up leftward (curved to the left) (curved delivery path 471 illustrated in FIG. 6.) The direction in which the original 100 is transported along the curved guiding path 411 is opposite to the direction in which the original 100 is transported along the curved delivery path 471. With this regard, the transportation roller 34 of the above described preferred embodiment is capable of switching a rotational direction, and also since the driven rollers 332 and 333 rotate in opposite directions each other, the transportation roller 34 can achieve the above described bidirectional transportation.

After transported along the double-face delivery path 47 and passing through the triplet of rollers 36, the original 100 is transported rightward and passes through the transportation roller 36 and then is transported diagonally downward right. In the same way as the original 100 transported along the single-face deliver path 43, the original 100 is output onto the paper output tray 53 with the shared roller 38 and the opposite roller 39. The double-face delivery path 47 located between a branching portion located relatively downward the transportation roller 36 and a branching portion located relatively upward the shared roller 38 connects the second inversion forward path 461 to the second inversion backward path 463 (connection path 472 illustrated in FIG. 6). As stated above, image information of both sides of the original 100 placed on the paper feed cassette 52 will be scanned.

In the present invention, the guiding path 41 is equivalent to a first transportation path provided on one side (left side in FIG. 3) of the scanning position 116 (original scanning portion) and the looped inversion path 45 (inversion path 46) positioned at the right side of the scanning position 116 is equivalent to a second transportation path provided on the other side of the scanning position 116.

<Jam Detection Portion>

Next, a structure of a jam detection portion 27 will be described. The jam detection portion 27, as illustrated in FIG. 3, includes a jam detection sensor 270. As one example, the jam detection sensor 270 is placed at an upstream side (right side in FIG. 3) of the triplet of rollers 35. The jam detection sensor 270 may be configured with an optically-reflective type sensor or an optically-transparent type sensor.

With a jam detection sensor having the optically-reflective type sensor, a light-emitting portion and a light-receiving portion are provided on one side of the transportation path, and when an original 100 is in the path, light irradiated from the light-emitting portion is reflected from a surface of the original 100 and the light receiving portion can receive the reflected light. When an original 100 is not in a path, light never be reflected. With a jam detection sensor including the optically-transparent type sensor, the light emitting portion and the light receiving portion are provided on both sides of the transportation path, when an original 100 is in the path, the light irradiated from the light emitting portion is blocked out and the light receiving portion cannot receive the light. When an original 100 is not in the path, since the light reaches the light receiving portion, the receiving portion can receive the light. As a specific configuration, such optical sensors may adopt various alternative preferred embodiments.

The jam detection sensor 270 is provided so as to detect the fact that an original 100 has been transported. If an original 100 is transported properly without any occurrence of paper jam, the jam detection sensor 270 detects a leading edge portion of the original 100, and detects a trailing edge portion within a given period of time. If the trailing edge portion is not detected in the given period of time, it is apparent that paper jam has occurred.

In FIG. 3, the jam detection sensor 270 is provided at an upstream side of the triplet of rollers 35. However, a plurality of jam detection sensors may be provided at any proper position. According to the position where the jam detection sensor is provided, the place where paper jam has occurred can be detected more precisely, which facilitate the following processing.

<Driving Mechanism of Transportation Roller 34 (Normal and Reverse Rotation Roller Portion)>

Next, it will be described how rotation force is transmitted to the transportation roller 34. As stated earlier, the transportation roller 34 of the preferred embodiment of the present invention is configured to rotate in one direction (normal rotation) when an original 100 is transported along the guiding path 41, and to rotate in the other direction (reverse rotation) when the original 100 is transported along the single-face delivery path 43 or the double-face delivery path 47.

In other words, the transportation roller 34 and its driven roller 34A construct the normal and reverse rotation roller portion 340, and for scanning one face of an original, the transportation roller 34 is driven to rotate in a normal direction (in a counterclockwise direction in FIG. 3), and for scanning both faces of an original, the transportation roller 34 is driven to rotate in both normal and reverse directions (in a clockwise direction in FIG. 3).

Figure 7:
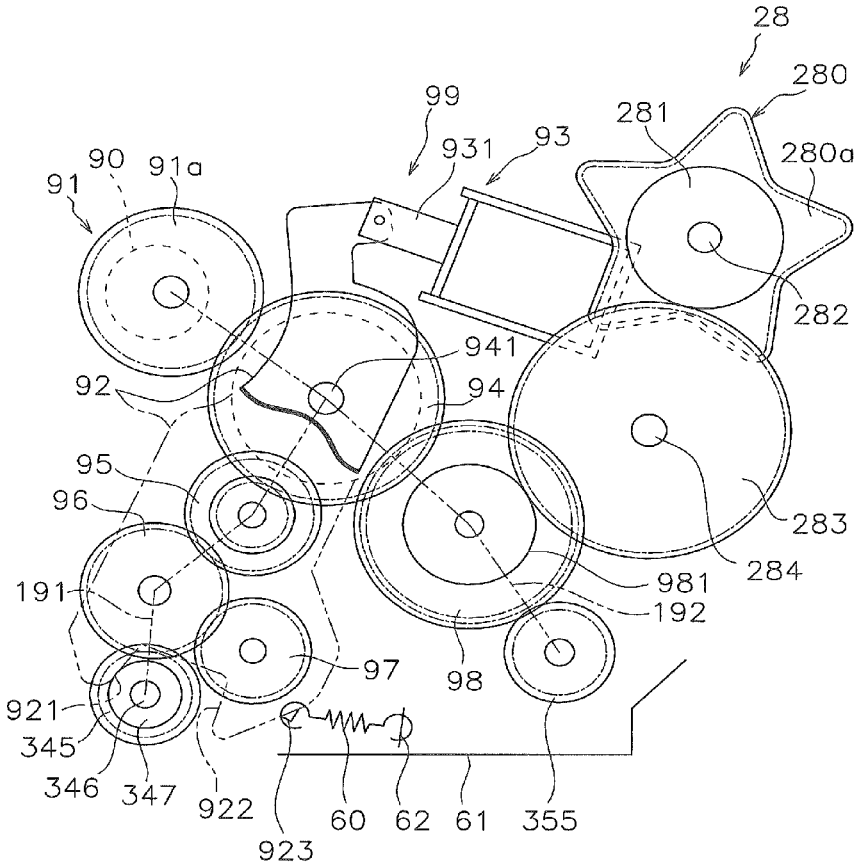
FIG. 7 is a front view illustrating a drive transmission path when a transportation roller is rotated in one direction (normal rotation).
Figure 10:
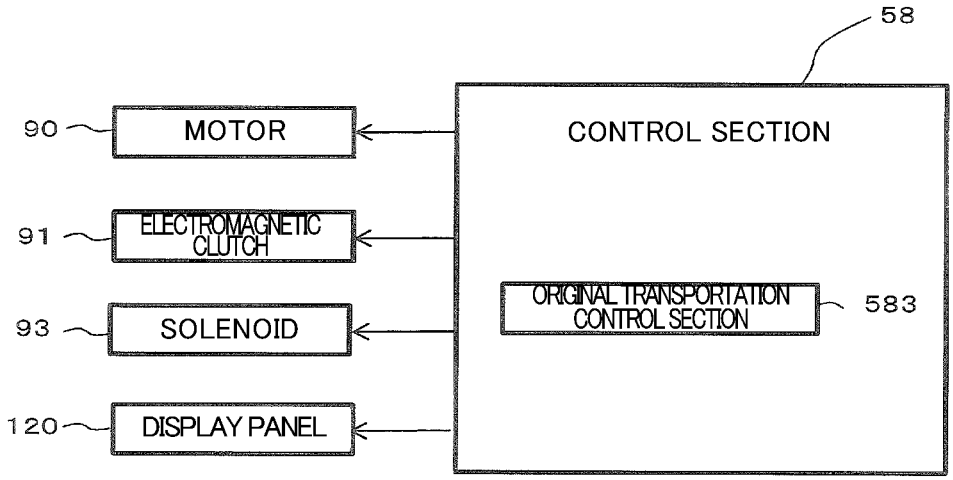
FIG. 10 is a block diagram illustrating a configuration of a control section.

At first, with reference to FIGS. 7 and 10, it will be described how power (rotation force) generated by the motor 90 (illustrated in FIG. 7) is transmitted to the transportation roller shaft 346 of the transportation roller 34 when the original 100 is transported along the guiding path 41. FIG. 7 is a front view illustrating a drive transmission path (first drive transmission path) 191 to drive the transportation roller 34 to rotate in one direction (normal rotation). FIG. 10 is a block diagram illustrating an electric structure of the ADF 24.

The motor 90 as a driving device is provided at the back side of the main body than the transportation roller shaft 346. The power generated by the motor 90 is transmitted to an electromagnetic clutch 91 positioned at the front side of the main body than the motor 90 through a transmission unit (not illustrated). Activating and stopping of the motor 90 is controlled with a control section 58 which controls the ADF 24 and the like (refer to FIG. 10).

As illustrated in FIG. 7, the electromagnetic clutch 91 includes an output gear 91*a* which engages with a power branching gear (transmission gear, rotation force branching gear) 94. The electromagnet clutch 91 is configured to be capable of switching the operation to transmit the power generated by the motor 91 to the output gear 91*a* or block out the power (that is, whether or not to transmit the power to the power branching gear 94). This switching operation is controlled by the control section 58 (refer to FIG. 10).

The power branching gear 94 is configured as a two-stepped gear composed of a gear having a large diameter and a gear having a small diameter. The gear of a large diameter engages with a transmission gear 95 provided diagonally downward left, and the gear of a small diameter engages with a transmission gear 98 provided diagonally downward right. Accordingly, rotation of the power branching gear 94 can be transmitted in two directions simultaneously.

Due to transmission of rotation of the power branching gear 94 to the transmission gear 95, the rotation is transmitted to a transportation roller gear 345 through a transmission gear 96. Further, a transportation roller shaft 346 rotates in response to the rotation of the transportation roller gear 345, which accordingly rotates the transportation roller 34. Thus, the power generated by the motor 90 is transmitted to the transportation roller 34 via the power transmission path 191.

Meanwhile, due to transmission of rotation of the power branching gear 94 to the transmission gear 98, the rotation is transmitted to a registration roller gear 355 which engages with the transmission gear 98. The registration roller gear 355 is a gear to rotate a rotation shaft of a registration roller 351 (refer to FIG. 3, etc.). Thus, the power generated by the motor 90 is transmitted to the registration roller 351 via a drive transmission path (second drive transmission path) 192.

Figure 8:
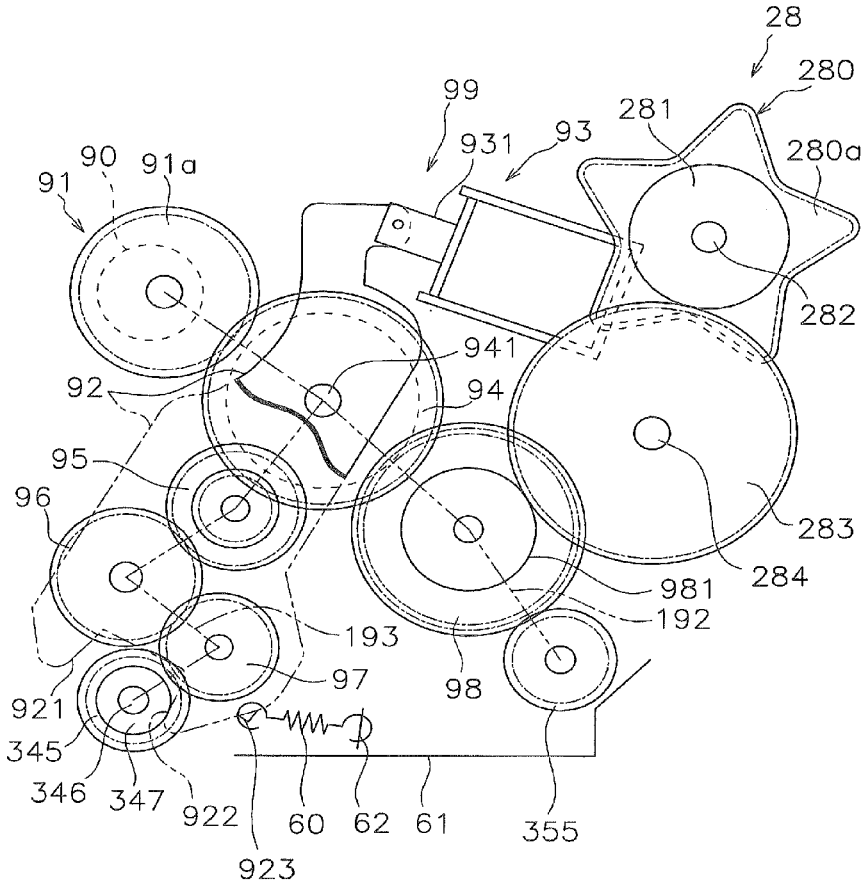
FIG. 8 is a front view illustrating a drive transmission path when a transportation roller is rotated in other direction (reverse rotation).
Figure 9:
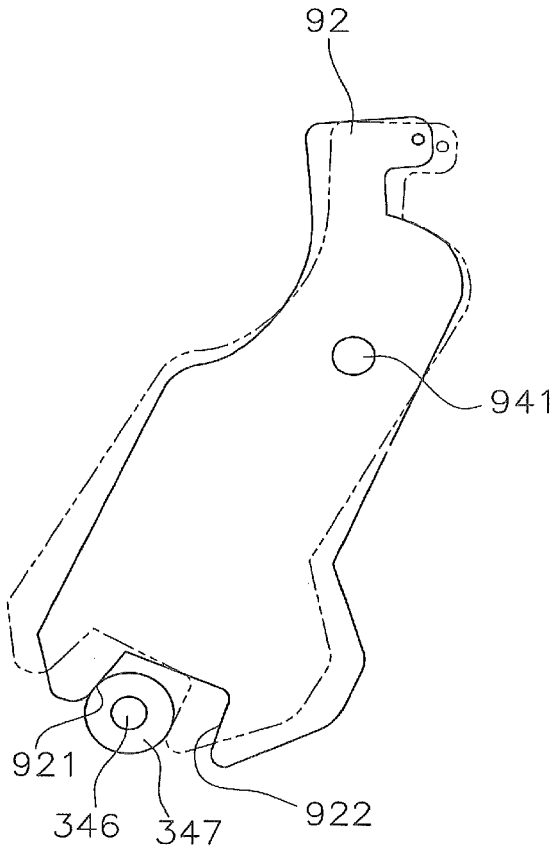
FIG. 9 is a view describing an oscillating oscillation bracket.

Next, with reference to FIGS. 8 and 9, it will be described how a rotational direction of the transportation roller 34 is switched and how the power generated by the motor 90 after the rotational direction is switched is transmitted to the transportation roller shaft 346. FIG. 8 is a front view illustrating a drive transmission path to rotate the transportation roller 34 in other direction (reverse rotation). FIG. 9 is a front view illustrating how the swingable bracket 92 swings.

In the preferred embodiment of the present invention, a rotational direction of the transportation roller 34 is switched by changing the number of gears used to transmit the power with a gear-number adjusting section 99. The gear-number adjusting section 99 consists of the oscillation bracket (oscillation body) 92 and a solenoid (an actuator that is a device to activate the oscillation body) 93. The gear-number adjusting section 99 is equivalent to a switching mechanism that shifts a rotational direction of the transportation roller 34 to a normal or reverse direction.

The swingable bracket 92 is configured by connecting two plate members parallel to each other, and the power branching gear 94 and the transmission gears 95 to 97 are attached to the swingable bracket 92. The power branching gear 94 is attached to the swingable bracket 92 through the branching gear shaft 941.

The solenoid 93 is connected to the upper edge portion of the swingable bracket 92. The swingable bracket 92 is configured to be capable of rotating upon the branching gear shaft 941 as a rotation shaft according to displacement of a movable iron core 931 of the solenoid 93 (Refer to FIG. 9.) In FIG. 9, a solid line represents a location of the swingable bracket 92 in a case where the transportation roller 34 is rotated in one direction, and a chain double-dashed line represents a location of the swingable bracket 92 in a case where the transportation roller 34 is rotated in the other direction. Timing of moving the movable iron core 931 of the solenoid 93 is controlled by the control section 58 (refer to FIG. 10).

The transmission gears 95, 96 and 97 are arranged to be capable of being relatively rotatable to the swingable bracket 92. The transmission gears 95, 96 and 97 are also configured to move their positions depending on the rotation of the swingable bracket 92.

With movement of the transmission gears 95, 96 and 97 from a position indicated in FIG. 7 to a position indicated in FIG. 8, the power generated by the motor 9 is transmitted along the drive transmission path (first drive transmission path) 193. Further, in the drive transmission path 193 illustrated in Fig. since the power is transmitted through a transmission path which has one more gears (transmission gear 97) compared to the drive transmission path 191 formed at the point indicated in FIG. 7, the rotational direction of the transportation roller 34 is inverted to an opposite direction. Thus, the control section 58 swings the swingable bracket 92 by controlling the solenoid 93, which can switch the rotational direction of the transportation roller 34.

Being formed to subside at a lower edge portion, the swingable bracket 92 is positioned with regulating surfaces 921 and 922 which are formed therein. Specifically, when the swingable bracket 92 swings from the position indicated in FIG. 7 to the position indicated in FIG. 8, the regulating surface 922 is in contact with a metal bush 347 arranged to be relatively rotatable upon the transportation roller shaft 346, and a position of the swingable bracket 92 is fixed. Meanwhile, when the swingable bracket 92 swings from the position indicated in FIG. 8 to the position indicated in FIG. 7, the regulating surface 921 is in contact with a metal bush 347, and a position of the swingable bracket 92 is fixed. Due to the positioning configuration, a proper distance can be maintained between shafts of the transmission gear 96 (transmission gear 97) and the transportation roller gear 345, which achieves smooth engagement therebetween. As the regulating surfaces 921 and 922 are placed near the transmission gears 96 and 97, the transmission gears are extremely precisely positioned.

It is preferred to activate the gear-number adjusting section 99 as explained below. That is, before swinging the swingable bracket 92, the control section 58 controls to stop the electromagnetic clutch 91 so that the rotation of the motor 90 is not transmitted to the power branching gear 94. Then, the control section 58 controls the solenoid 93 so as to move the swingable bracket 92 from the position indicated in FIG. 7 to the position indicated in FIG. 8. Then, the control section 58 controls the electromagnetic clutch 91 to be connected, and the rotation of the motor 90 is transmitted to the power branching gear 94. Accordingly, the rotation force is not transmitted to the transmission gear 96 (transmission gear 97) when the transportation roller gear 345 is switched to engagement or engagement release, which prevents damage to gears at an engagement portion.

As explained above, the ADF 24 of the preferred embodiment of the present invention includes the original transportation path 40, the transportation roller 34, the motor 90, the power branching gear 94, the transmission gears 95 to 97, the electromagnetic clutch 91, the gear-number adjusting section 99 and the control section 58. The original transportation path 40 is for transporting the original 100. The transportation roller 34 is provided in the original transportation path 40 and is capable of rotating in two directions. The motor 90 rotates in one direction and generates rotation force to rotate the transportation roller 34. The transmission gears 95 to 97 transmit the rotation force to the transportation roller 34. The electromagnetic clutch 91 is capable of switching the operation of transmitting the rotation force to the power branching gear 94 or blocking. The gear-number adjusting section 99 is capable of changing the number of transmission gears where the rotational power goes through before being transmitted to the transportation roller 34.

The control section 58 controls the electromagnetic clutch 91 and the gear-number adjusting section 99. The control section 58 performs the following three steps to switch a rotational direction of the transportation roller 34 which is rotating. In the first step, the rotation force is blocked with control of the electromagnetic clutch 91. In the second step, the number of transmission gears where the rotation force is transmitted is increased or decreased by one with the control of the gear-number adjusting section 99. In the third step, the rotation force in the same direction as the first step is transmitted with the control of the electromagnetic clutch 91.

Accordingly, as only one electromagnetic clutch 91 can switch a rotational direction of the transportation roller 34 without switching the rotational direction of the motor 90, it also become possible to make a compact and low-cost ADF 24. Further, since the electromagnetic clutch 91 blocks the rotation force while the control section 58 changes the number of gears where the rotation force of the motor 90 goes through, the tooth of the gears can be prevented from being damaged.

In the ADF 24 of the preferred embodiment of the present invention, the gear-number adjusting section 99 includes the swingable bracket 92 and the solenoid 93. The transmission gears 95 to 97 are relatively rotatably provided at the swingable bracket 92. The solenoid 93 changes the number of the transmission gears where the rotation force goes through by swinging the swingable bracket 92.

Thus, the rotational direction of the transmission roller 34 can be switched with such a simple configuration.

In the swingable bracket 92, a hook provided on one side of a coil spring 60 (equivalent to an urging member) is attached to a locking portion 923 (refer to FIG. 7.) A hook provided on the other side of the coil spring 60 is attached to a locking portion 62 formed on a metal base plate 61 arranged to attach a driving unit. Accordingly, the swingable bracket 92 is urged in a counterclockwise direction around a branching gear shaft 941. When the solenoid 93 is OFF, as illustrated in FIG. 7, the transportation roller 34 is set to rotate in a normal direction. Once the solenoid 93 is ON, the solenoid 93 makes the oscillation bracket 92 to rotate in a clockwise direction against the urging force of the coil spring 60, and the transportation roller 34 is set to rotate in an opposite direction with the gear-number adjusting section 99.

In the ADF 24 of the preferred embodiment of the present invention, the position of the swingable bracket 92 is fixed by making the metal bush 347 contact with the regulating surfaces 921 and 922 of the swingable bracket 92.

Thus, the position of the swingable bracket 92 can be fixed with such s simple configuration, which makes it possible to make low-cost compact ADFs 24.

In the ADF 24 of the preferred embodiment of the present invention, the swingable bracket 92 is capable of changing the number of gears where the rotation force goes through by rotating upon the branching gear shaft 941. The branching gear shaft 941 is provided at a branching point between a drive transmission path 191 transmitting the rotation of the motor 90 to the transportation roller 34 and a drive transmission path 193 transmitting the rotation of the motor 90 to the registration roller gear 355.

Thus, since the power branching gear 94 is not displaced even if the swingable bracket 92 is swung, the rotation is also transmitted to the registration roller 351 along the drive transmission path 192 while the rotation is transmitted to the transportation roller 34. Therefore, when a rotational direction of the transportation roller 34 is inverted, it becomes possible to rotate the registration roller 351 in the same direction. Further, since the transportation roller 34 and the registration roller 351 can share the motor 90 and the electromagnetic clutch 91, low-cost ADFs 24 can be realized by reducing the number of components to be used.

The control section 58 illustrated in FIG. 10 functions as an original transportation control section 583. When a front face of an original 100 is scanned, the original transportation control section 583 controls to transport the original 100 with the transportation roller 34 (first roller portion) rotating in a normal direction and the second roller portion (registration roller 351 and driven roller 352) of the triplet of rollers 35. Moreover, when a back face of the original is scanned, the original transportation control section 583 controls to transport the original 100 with the transportation roller 34 (fourth roller portion) rotating in a reverse direction and the third roller portion (registration roller 351 and driven roller 353) of the triplet of rollers 35.

<Jam Releasing Section>

Next, it will be described how a jam releasing section 28 solves paper jam. FIG. 7 represents a structure of the jam releasing section 28. The jam releasing section 28 includes an operation dial 280 and a transmission gear 281 formed integrally with the operation dial 280 on the same shaft. An operation shaft 282 is provided at the center of the rotation. A protrusion 280*a* is formed along a circumferential direction so that a user can handle the operation dial 280 easily.

An inter-transmission gear 283 engaging with a transmission gear 281 is configured to be capable of rotating upon a rotation shaft 284. The inter-transmission gear 283 also engages with the transmission gear 981 provided integrally with the transmission gear 98 on the same shaft. Therefore, the transmission gear 98 is rotated by rotating the operation dial 280, which allows the user to manually rotate the transportation roller 34 and the registration roller gear 355 (registration roller 351) of the triplet of rollers 35 simultaneously in conjunction with the rotation of the transmission gear 98. According to a rotational direction controlled by the operation dial 280, the rotational direction of the transportation roller 34 and the registration roller 351 can be changed.

<Transporting Speed Adjusting Unit>

Figure 11:
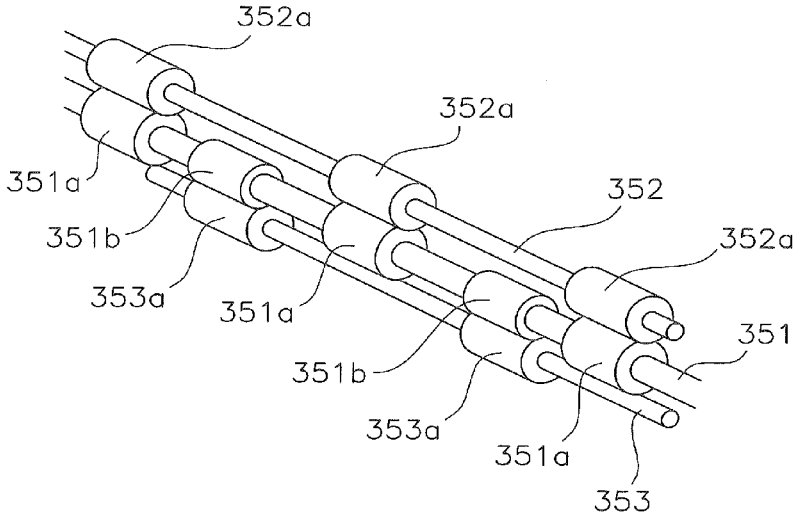
FIG. 11 is a schematic view (first preferred embodiment) describing a diameter of a drive roller of a normal and reverse roller portion (D1) and each diameter of a drive roller of a triplet of rollers (D2, D3).

Next, with reference to FIG. 11, a structure of the transporting speed adjusting unit consisting of the normal and reverse rotation roller portion and the roller unit will be described. FIG. 11 is a schematic view illustrating the triplet of rollers 35 composed of the registration roller 351 (drive roller), the first driven roller 352 and the second driven roller 353. At a shaft of the registration roller 351, a first rubber roller portion 351*a* and a second rubber roller portion 351*b*, each of which has a different diameter, are provided. A rubber roller portion 352*a* provided at a shaft of the first driven roller 352 is in contact with the first rubber portion 351*a* and a rubber roller portion 353*a* provided at a shaft of the second driven roller 353 is in contact with the second rubber portion 351*b*. Provided that external diameters of the first rubber roller portion 351*a* and the second rubber roller portion 351*b* are a roller diameter D2 and D3 respectively and also a diameter of a roller in contact with the driven roller 34A of the transportation roller 34 (the periphery in contact with an original 100) is D1, the following relations are established: D2>D1>D3. Due to the relations, when the original 100 is fed with the transportation roller 34 rotating in a normal direction, and is transported with the registration roller 351 and the first driven roller 352, a circumferential velocity V2 of the triplet of rollers 35 is faster than a circumferential velocity V1 of the transportation roller 34 rotating in a normal direction, and thus the original 100 can be transported with a sufficient drawing tension as it is stretched. Meanwhile, when the original 100 is fed with the registration roller 351 and the second driven roller 353 and is transported with the transportation roller 34 rotating in a reverse direction, the circumferential velocity V1 of the transportation roller 34 is faster than the circumferential velocity V3 of the triplet of rollers 35, and thus the original 100 can be transported with a sufficient drawing tension as it is stretched.

The motor and the transmission unit are set so that the transportation roller 34 and the registration roller (drive roller) 351 of the triplet of rollers are rotated at the same rotation frequency (n [rpm]). Further, as each of external diameters D1, D2 and D3 of the transportation roller 34, the first rubber roller portion 351 and the second rubber roller portion 351*b* (diameter 2r) is different from each other, each circumferential velocity ($2\pi nr$ [mm/min]) is also different from each other.

(Alternative Configuration of the First Preferred Embodiment)

Figure 15:
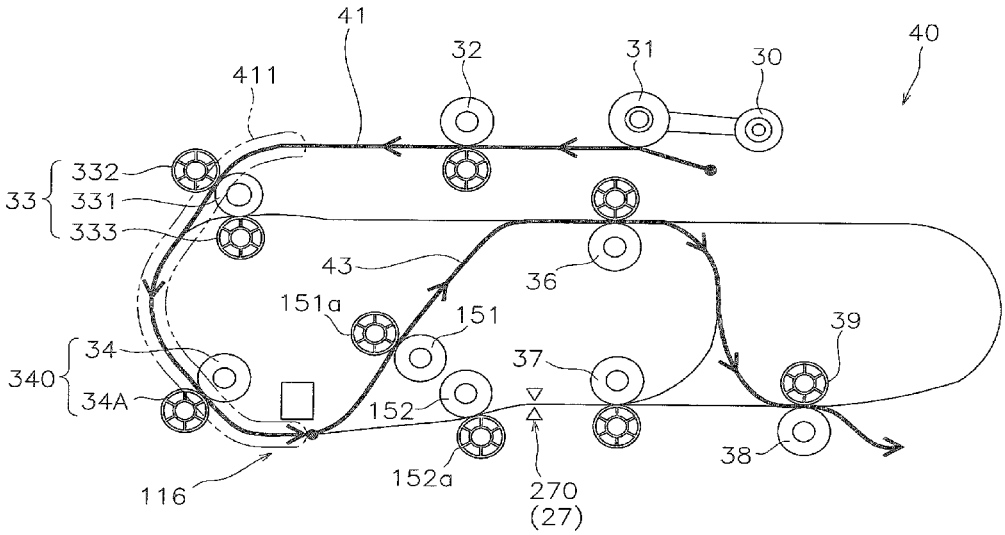
FIG. 15 is a schematic view (another example of the first preferred embodiment) describing the guiding path and the single face delivery path.

In the above described first preferred embodiment, the second roller portion and the third roller portion are configured as one triplet of rollers. However, not limited to this configuration, the second roller portion and the third roller portion may be configured as an individual transportation roller. As illustrated in FIG. 15, the second roller portion consists of a drive roller 151 and its driven roller 151*a*, and the third roller portion consists of a drive roller 152 and its driven roller 152*a*. In such a configuration, an external diameter of the transportation roller 34 in contact with an original is smaller than an external diameter of the drive roller 151 in contact with the original, and is larger than an external diameter of the drive roller 152 in contact with the original. Note that the transportation roller 34 and drive rollers 151 and 152 are rotated at the same rotation frequency.

Further, in the above described first preferred embodiment, the first roller portion and the fourth roller portion are configured as one normal and reverse rotation roller portion. However, not limited to this configuration, the first roller portion and the fourth roller portion may be configured as an individual transportation roller. The first roller portion consists of a drive roller and a driven roller and the fourth roller portion consists of a drive roller and a driven roller. In such a configuration, an external diameter of the first roller portion in contact with an original is smaller than an external diameter of the first rubber roller portion 351*a* and is larger than an external diameter of the second rubber roller portion 351*b*. Note that each drive roller is rotated at the same rotation frequency.

Furthermore, the first, the second, the third and the fourth roller portions may be configured as an individual transportation roller (each of the portions consists of a drive roller and a driven roller). In such a configuration, an external diameter of the drive roller of the first roller portion in contact with an original is smaller than an external diameter of the drive roller of the second roller portion in contact with the original, and also an external diameter of the drive roller of the third roller portion in contact with the original is smaller than an external diameter of the drive roller of the fourth roller portion in contact with the original. Note that each drive roller of roller portions is rotated at the same rotation frequency.

Second Preferred Embodiment 2

In the above described first preferred embodiment of the present invention, the normal and reverse rotation roller portion (configured with the first roller portion and the fourth roller portion) is provided at the first transportation path, and the triplet roller unit (configured with the second roller portion and the third roller portion) is provided at the second transportation path. However, in a second preferred embodiment of the present invention, a first triplet roller unit (configured with the first roller portion and the fourth roller portion) is provided at the first transportation path and a second triplet roller unit (configured with the second roller portion and the third roller portion) is provided at the second transportation path. Note that a motor and a transmission unit are set to rotate registration rollers (drive roller) of the first and the second triplet roller units at the same rotation frequency (n[rpm]).

Figure 12:
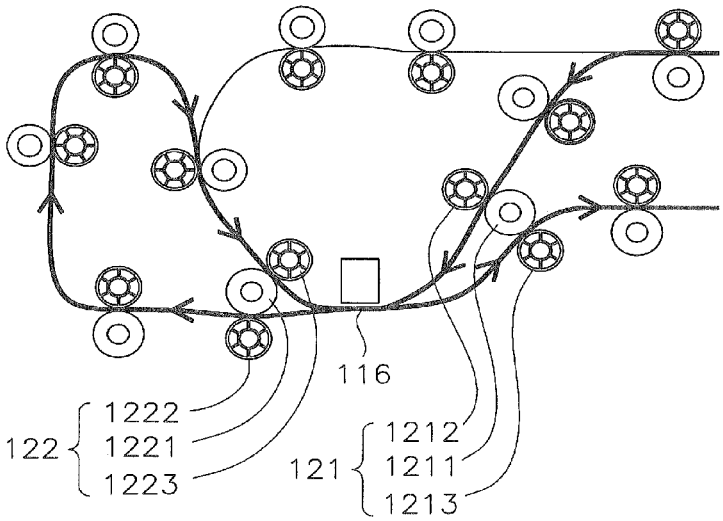
FIG. 12 is a schematic view (second preferred embodiment) describing a guiding path and a single-face deliver path.

With reference to FIG. 12, an internal structure of the ADF 24 of the second preferred embodiment will be described. A bold arrowed line of FIG. 12 indicates a transportation path for duplex scanning. In FIG. 12, a first transportation path to feed the original 100 is configured at a right side of the scanning position 116 of an original scanning section (not illustrated), and a looped second transportation path to turn around the original 100 is configured at a left side of the scanning position 116 of an original scanning section. At both sides of the scanning position 116, triplet roller units 121 and 122 are provided. The first triplet roller unit 121 consists of a registration roller 1211 (drive roller) positioned in the middle thereof and driven rollers 1212 and 1213 positioned above and below the registration roller 1211 to sandwich the registration roller 1211. The second triplet roller unit 122 consists of a registration roller 1221 (drive roller) positioned in the middle thereof and driven rollers 1222 and 1223 positioned above and below the registration roller 1221 to sandwich the registration roller 1211. When a first face (in FIG. 12, back face) of an original 100 is scanned, the original 100 is fed with the registration roller 1211 and the driven roller 121 of the first triplet roller unit 121 to the scanning position 116, and is transported in the second transportation path with the registration roller 1221 and the driven roller 1222 of the second triplet roller portion. The original 100 is turned around in the second transportation path, and the turned original 100 is fed with the registration roller 1221 and the driven roller 1223 of the second triplet roller unit to the scanning position 116. Then, the original 100 is transported with the registration roller 1211 and the driven roller 1213 of the first triplet roller unit 121 to an output direction at a downstream side.

<Transporting Speed Adjusting Unit>

Figure 13:
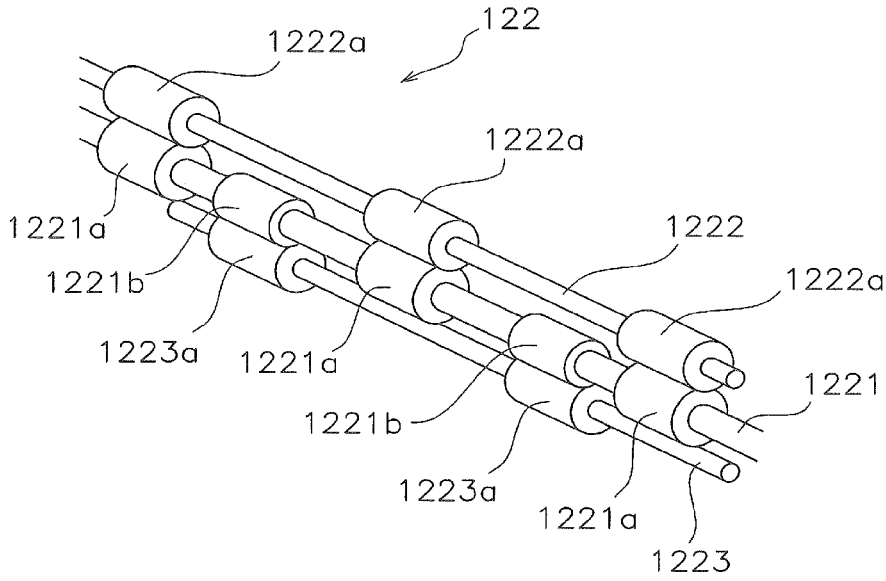
FIG. 13 is a schematic view (second preferred embodiment) describing a diameter of a drive roller of one triplet of rollers (D1) and each diameter of drive rollers of another triplet of rollers (D2, D3).

A transporting speed adjusting unit of the second preferred embodiment of the present invention is configured with the first triplet of rollers and the second triplet rollers. As illustrated in FIG. 13, in the second triplet roller unit 122 provided on the second transportation path, first and second rubber roller portions 1221*a* and 1221*b* having a different external diameter each other are provided on a shaft of the registration roller 1211. A rubber roller portion 1222*a* provided on a shaft of the first driven roller 1222 is in contact with the first rubber roller portion 1221*a* and a rubber roller portion 1223*a* provided on a shaft of a second driven roller 1223 is in contact with the second rubber portion 1221*b*. Provided that an external diameter of the first rubber roller portion is D2, an external diameter of the second rubber roller portion 1221*b* is D3, and also an external diameter of the registration roller 1211 of the first triplet rollers 121, which is provided on the first transportation path, in contact with the first and second driven rollers 1212 and 1213 (a periphery in contact with the original 100) is D1, the following relations are established: D2>D1>D3. Accordingly, when the original 100 is fed with the registration roller 1211 and the driven roller 1212 and is transported with the registration roller 1221 and the driven roller 1222, a circumferential velocity V2 of the second triplet of rollers 122 is faster than a circumferential velocity V1 of the first triplet of rollers 121, and thus the original 100 can be transported with a sufficient drawing tension as it is stretched. Meanwhile, when an original 100 is fed with the registration roller 1221 and the driven roller 1223 and is transported with the registration roller 1211 and the driven roller 1213, a circumferential velocity V1 of the first triplet of rollers 121 is faster than a circumferential velocity V3 of the second triplet of rollers 122, and thus the original 100 can be transported with a sufficient drawing tension as it is stretched. (V2>V1>V3)

(Alternative Configuration of the Second Preferred Embodiment)

Figure 14:
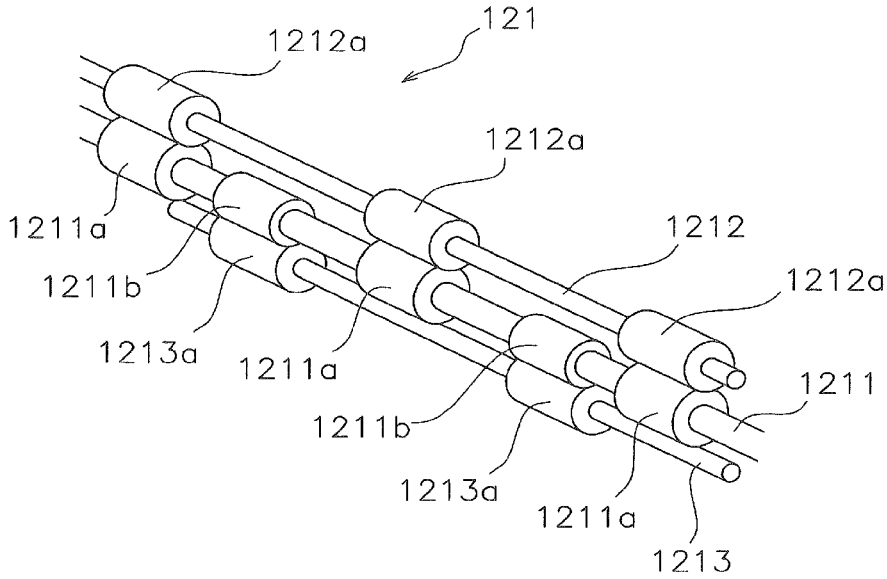
FIG. 14 is a schematic view (another example of the second preferred embodiment) describing a diameter of a drive roller of one triplet of rollers (D11) and each diameter of drive rollers of another triplet of rollers (D12, D13).

In the above described second preferred embodiment of the present invention, the diameter of the drive roller of the second triplet of rollers is adjusted. However, the diameter of the drive roller of the first triplet of rollers may be adjusted. Specifically, as illustrated in FIG. 14, in the first triplet of rollers 121 provided on the first transportation path, a first rubber portion 1211*a* and a second rubber portion 1211*b*, each of which has a different diameter, are provided on a shaft of the registration roller 1211, and a rubber roller portion 1212*a* provided on a shaft of a first driven roller 1212 is in contact with the first rubber roller portion 1211*a*, and a rubber roller portion 1213*a* provided on a shaft of the second driven roller 1213 is in contact with the second rubber roller portion 1211*b*.

Provided that an external diameter of the first rubber portion 1211*a* is D12, an external diameter of the second rubber roller portion 1211*b* is D13, and also an external diameter of the registration roller 1221 of the second triplet of rollers 122 provided on the second transportation path in contact with the first and second driven rollers 1222, 1223 (a periphery in contact with the original 100) is D11, the following relations are established: D13>D11>D12.

Accordingly, when an original 100 is fed with the registration roller 1211 and the driven roller 1212 and is transported with the registration roller 1221 and the driven roller 1222, a circumferential velocity V2 of the second triplet of rollers 122 (V2) is faster than a circumferential velocity V1 of the first triplet of rollers 121, and thus the original 100 can be transported with a sufficient drawing tension as it is stretched. Meanwhile, when an original 100 is fed with the registration roller 1221 and the driven roller 1223 and is transported with the registration roller 1211 and the driven roller 1213, a circumferential velocity V1 of the first triplet of rollers 121 is faster than a circumferential velocity V3 of the second triplet of rollers 122, and thus the original 100 can be transported with a sufficient drawing tension as it is stretched. (V2>V1>V3)

Third Preferred Embodiment

In the above described first preferred embodiment of the present invention, the diameter of the registration roller 351 (drive roller) of the triplet of rollers 35 provided on the second transportation path is adjusted according to an external diameter of the transportation roller 34 in contact with the original 100. However, in a third preferred embodiment of the present invention, each of normal rotation frequency and reverse rotation frequency of the transportation roller 34 (normal and reverse rotation roller unit) provided on the first transportation path is adjusted according to a rotation frequency of the registration roller 351 of the triplet of rollers 35.

The transporting speed adjusting unit is configured with a transmission unit to transmit rotation of the motor, which rotates in one direction, to the transportation roller 34 and the registration roller 351 of the triplet of rollers 35. The motor 90 and the transmission unit have been already described in the first preferred embodiment. Specifically, the transmission unit includes a plurality of gears, and gear ratios (number of gear tooth) are set as follows: a gear rotation frequency R3 in rotating the registration roller 351 of the triplet of rollers 35 is faster than a gear rotation frequency R1 in rotating the transportation roller 34 in a normal direction and also is slower than a gear rotation frequency R2 in rotating the transportation roller 34 in an opposite direction. (R2>R3>R1) Accordingly, when an original 100 is fed with the transportation roller 34 rotating in a normal direction and is transported with the registration roller 351 and the first driven roller 352, the circumferential velocity V2 of the triplet of rollers is faster than the circumferential velocity V1 of the transportation roller 34 rotating in a normal direction, and thus the original 100 can be transported with a sufficient drawing tension as it is stretched. Meanwhile, when an original 100 is fed with the registration roller 351 and the second driven roller 353 and is transported with the transportation roller 34 rotating in a reverse direction, the circumferential velocity V1 of the transportation roller 34 is faster than the circumferential velocity of the triplet roller 35 rotating in the reverse direction, and thus the original 100 can be transported with a sufficient drawing tension as it is stretched. (V2>V1>V3)

(Alternative Configuration of the Third Preferred Embodiment)

In the above described third preferred embodiment of the present invention, the second roller portion and the third roller portion are configured as one triplet of rollers 35. However, not limited to this configuration, the second roller portion and the third roller portion may be configured as an individual transportation roller. As illustrated in FIG. 15, the second roller portion consists of the drive roller 151 and the driven roller 151*a*, and the third roller portion consists of the drive roller 152 and the driven roller 152*a*.

Further, the first roller portion and the fourth roller portion are configured as one normal and reverse rotation roller portion. However, not limited to this configuration, the first roller portion and the fourth roller portion may be configured as an individual transportation roller. The first roller portion consists of a drive roller and a driven roller and the fourth roller portion consists of a drive roller and a driven roller. In such a configuration, gear ratios are set as follows: the gear rotation frequency R3 in rotating the registration roller 351 of the triplet of rollers 35 is faster than the gear rotation frequency R1 in rotating the drive roller of the first roller portion, and also is slower than the gear rotation frequency R2 in rotating the drive roller of the fourth roller portion.

Furthermore, the first, the second, the third and the fourth roller portions may be configured as individual transportation rollers (each of the portions consists of a drive roller and a driven roller). In such a configuration, gear ratios are set as follows: a gear rotation frequency in rotating the drive roller of the second roller portion is faster than a gear rotation frequency in rotating the drive roller of the first roller portion, and also a gear rotation frequency in rotating the drive roller of the fourth roller portion is faster than a gear rotation frequency in rotating the drive roller of the third roller portion. A transmission unit may be configured to be capable of rotating each drive roller with a single or a plurality of motors.

Instead of the motor 90 which rotates in one direction to rotate a normal and reverse rotation portion, a motor capable of rotating in both normal and reverse directions may be adopted. In such a configuration, a rotation frequency needs to be controlled to be different in rotating in a normal direction and a reverse direction in order to establish the above described relations. (V2>V1>V3)<

Another Embodiment

In the present invention, terms of "normal rotation" and "reverse rotation" are used in this specification. As a matter of convenience, a rotational direction in which a transportation roller 34 rotates when a first face (i.e., front face) of an original is scanned is referred to as normal rotation, and a rotation direction in which the transportation roller 34 rotates when a second face (i.e., back side) of an original is scanned is referred to as inversion rotation. Therefore, the rotational directions are not limited to a clockwise direction or a counterclockwise direction. In addition, the triplet of rollers rotates in one direction only.

Preferred embodiments of the present invention have been described so far. However, the above described configurations may be changed as follows.

Instead of a scanner unit 25 of a optical system for reducing used in the above described preferred embodiments, the configuration of the present invention may be applied to a configuration with a contact type image sensor or the like.

The gear-number adjusting section 99 is configured to be capable of changing the number of gears where a rotation force goes through according to the rotation of the swingable bracket 92. However, the gear-number adjusting section 99 may be configured to be capable of changing the number of gears where the rotation force goes through according to a sliding movement (parallel displacement) of the swingable bracket 92 without swinging thereof. In this way, various alternative methods may be adopted to change the number of gears where the rotation force goes through.

In the above described preferred embodiments, transmission gears 96 and 97 rotating in conjunction with the swingable bracket 92 transmit rotation directly to a transportation roller gear 345. Instead of this configuration, a transmission gear swinging in conjunction with the swingable bracket 92 may transmit the rotation to other transmission gears and the transmission gear may transmit the rotation to the transportation roller gear 345. In this case, a bearing or the like attached to a shaft of the transmission gear may be used as a member to position the swingable bracket 92.

The above preferred embodiments describes examples in which the present invention is applied to an ADF 24 capable of scanning both faces of an original using a path where the original is turned around. However, the present invention may also be applied to a switchback roller of an ADF provided with a switchback function to reverse a direction in which an original is transported. Not only for the ADF, the configuration of the present invention may be applied to various applications, if a device transports an original sheet of paper one by one. For example, the configuration of the present invention may be applied to a switchback roller of a multifunctional peripheral capable of printing both sides of an original.

In the above described preferred embodiments, the image scanner 11 is provided as part of the multifunctional peripheral 1. Instead of this configuration, the image scanner may be configured as an individual scanner.

While the present invention has been described with respect to preferred embodiments thereof, it will be apparent to those skilled in the art that the disclosed invention may be modified in numerous ways and may assume many preferred embodiments other than those specifically set out and described above. Accordingly, it is intended by the appended claims to cover all modifications of the present invention that fall within the true spirit and scope of the present invention.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An automatic document feeder comprising:

an original scanning section to scan a face of an original sheet of paper;

a first transportation path provided at one side of a scanning position of the original scanning section to guide the original to the scanning position of the original scanning section so that a first face of the original can be scanned;

a looped second transportation path provided at the other side of the scanning position to guide the original to the scanning position so that a second face of the document can be scanned;

a first roller portion provided on the first transportation path to feed the original to the scanning position so that the first face of the original can be scanned;

a second roller portion provided on the looped second transportation path to transport the original that has been sent out from the first roller portion and scanned at the scanning position along the looped second transportation path;

a third roller portion provided on the looped second transportation path to feed the original to the scanning section so that the second face of the original can be scanned;

a fourth roller portion provided on the first transportation path to transport the original that has been sent out from the third roller portion and scanned at the scanning section;

an original transportation control section that controls to transport the original from the first transportation path to the looped second transportation path with the first roller portion and the second roller portion when the first face of the original is scanned and to transport the original from the looped second transportation path to the first transportation path with the third roller portion and the fourth roller portion when the second face of the original is scanned; and a transporting speed adjusting unit that controls a circumferential velocity of the second roller portion to be faster than the one of the first roller portion when the original is transported from the first transportation path through the scanning position to the looped second transportation path, and also controls a circumferential velocity of the fourth roller portion to be faster than the one of the third roller portion when the original is transported from the looped second transportation path through the scanning position to the first transportation path.

2. The automatic document feeder according to claim 1, further comprising:

a roller unit including a single drive roller and a first driven roller and a second driven roller both of which rotate in conjunction with the drive roller; the drive roller and the first driven roller are configured as the first roller portion and also the drive roller and the second roller portion are configured as the fourth roller portion, or the drive roller and the first driven roller are configured as the second roller portion and also the drive roller and the second driven roller are configured as the third roller portion, wherein in a case where the transportation speed adjusting section is configured with a roller unit defined by the first roller portion and the fourth roller portion, an external diameter D1 of the drive roller in contact with the first driven roller of the first roller portion is set to be smaller than an external diameter D4 of the drive roller in contact with the second driven roller of the fourth roller portion, or in a case where the transportation speed adjusting unit is configured with a roller unit composed of the second roller portion and the third roller portion, an external diameter D2 of the drive roller in contact with the first driven roller of the second roller portion is set to be larger than an external diameter D3 of the second driven roller of the third roller portion.

3. The automatic document feeder according to claim 1, further comprising:

a normal and reverse rotation roller portion including a single drive roller and a single driven roller which rotates in conjunction with the drive roller; the drive roller rotating in a normal direction and the driven roller are configured as the first roller portion, and the drive roller rotating in a reverse direction and the driven roller are configured as the fourth roller portion, and a roller unit including a single drive roller and a first driven roller and a second driven roller both of which rotate in conjunction with the drive roller; the drive roller and the first driven roller are configured as the second roller portion, and the drive roller and the second driven roller are configured as the third roller portion, wherein the original transportation control section controls to transport the original from the first transportation path to the looped second transportation path through the first roller portion rotating in a normal direction and the second roller portion when the first face of the original is scanned, and to transport the original from the looped second transportation path to the first transportation path through the third roller portion and the fourth roller portion rotating in a reverse direction when the second face of the original is scanned, and wherein the transporting speed adjusting unit is configured with the normal and reverse rotation roller portion and the roller unit; the normal and reverse rotation roller portion in rotating both normal and reverse directions and the roller of the roller unit are set to rotate at the same rotation frequency, and a diameter of the normal and reverse rotation roller portion is set to be smaller than an external diameter of the drive roller in contact with the first driven roller of the second roller portion and also is set to be larger than an external diameter of the drive roller in contact with the second driven roller of the third roller portion.

4. The automatic document feeder according to claim 1, further comprising:

a first roller unit including a single drive roller and a first driven roller and a second driven roller both of which rotate in conjunction with the drive roller; the drive roller and the first driven roller are configured as the first roller portion and the drive roller and the second driven roller are configured as the fourth roller portion, and a second roller unit including a single drive roller and a first driven roller and a second driven roller both of which rotate in conjunction with the drive roller; the drive roller and the first driven roller are configured as the second roller portion and the drive roller and the second driven roller are configured as the third roller portion;

wherein the transporting speed adjusting unit is configured with the first roller unit or the second roller unit; each drive roller of the first roller unit and the second roller unit are set to rotate at the same rotation frequency, and an external diameter of the drive roller in contact with the first driven roller and the second driven roller of the first roller unit is smaller than an external diameter of the drive roller in contact with the first driven roller of the second roller portion and also is set to be larger than an external diameter of the drive roller in contact with the second driven roller of the third roller potion, or an external diameter of the drive roller in contact with the first driven roller and the second driven roller of the second roller unit is set to be larger than an external diameter of the drive roller in contact with the first driven roller of the first roller portion and also is set to be smaller than an external diameter of the drive roller in contact with the second driven roller of the fourth roller portion.

5. The automatic document feeder according to claim 1, further comprising:

a normal and reverse rotation roller portion including a drive roller and a driven roller which rotates in conjunction with the drive roller; the drive roller rotating in a normal direction and the driven roller are configured as the first roller portion, and the drive roller rotating in a reverse direction and the driven roller are configured as the fourth roller portion, and a roller unit including a single drive roller and a first driven roller and a second driven roller both of which rotate in conjunction with the drive roller; the drive roller and the first driven roller are configured as the second roller portion, and the drive roller and the second driven roller are configured as the third roller portion, wherein the original transportation control section controls to transport an original from the first transportation path to the looped second transportation path through the first roller portion rotating in a normal direction and the second roller portion when a first face of the original is scanned, and controls to transport the original from the looped second transportation path to the first transportation path through the third roller portion and the fourth roller portion rotating in a reverse direction when an second face of the original is scanned, and wherein the transporting speed adjusting unit is configured with a transmission unit to transmit rotation of a motor rotating in one direction to the normal and reverse rotation roller portion and the roller unit, and in the transmission unit a gear ratio is set such that a gear rotation frequency in rotating the drive roller of the roller unit is faster than a gear rotation frequency in rotating the normal and reverse roller portion in a normal direction and also is slower than a gear rotation frequency in rotating the normal and reverse rotation roller potion in the reverse direction.

6. The automatic document feeder according to claim 5, further comprising:

a switching mechanism to switch rotation of the normal and reverse rotation roller portion to a normal or reverse direction, and, an actuator to drive the switching mechanism to a normal rotation position or a reverse rotation position;

wherein the switching mechanism switches the rotation of the normal and reverse rotation roller portion between a normal or reverse direction by changing the number of gears composing a gear train driven by the motor.

* * * * *